US005092713A

United States Patent [19]

Salama

[11] Patent Number: 5,092,713

[45] Date of Patent: Mar. 3, 1992

[54] HIGH AXIAL LOAD TERMINATION FOR TLP TENDONS

[75] Inventor: Mamdouh M. Salama, Ponca City, Okla.

[73] Assignee: Conoco Inc., Ponca City, Okla.

[21] Appl. No.: 613,429

[22] Filed: Nov. 13, 1990

[51] Int. Cl.[5] ..... B63B 21/50; E02B 17/00; F16L 27/04; F16L 27/10

[52] U.S. Cl. ..... 405/224; 405/195.1; 114/265; 285/293; 285/423

[58] Field of Search ..... 156/172; 405/195, 202, 405/203, 204, 224, DIG. 8; 114/264, 265, 294, 311; 403/133, 135, 225, 226; 285/149, 293, 423

[56] References Cited

U.S. PATENT DOCUMENTS

| | | | |
|---|---|---|---|
| 3,038,743 | 6/1962 | Zaloumis | 403/226 X |
| 3,261,910 | 7/1966 | Jacquier | 156/172 X |
| 3,613,736 | 10/1971 | Kuwabara | 285/149 X |
| 3,850,722 | 11/1974 | Kreft | 156/172 |
| 4,149,277 | 4/1979 | Bokros . | |
| 4,248,549 | 2/1981 | Czerewaty | 405/224 |
| 4,420,276 | 12/1983 | Roberts | 405/224 |
| 4,491,687 | 1/1985 | Kaczerginski et al. | 156/172 X |
| 4,955,970 | 9/1990 | Kivi et al. | 285/149 |
| 4,974,245 | 11/1990 | Mioque et al. | 285/149 X |

*Primary Examiner*—Randolph A. Reese
*Assistant Examiner*—John Ricci
*Attorney, Agent, or Firm*—A. Joe Reinert

[57] ABSTRACT

A composite tubular tendon containing axial fibers and helical fibers laid on an inner liner is connected to a circular opening in a hollow termination body having an opposite curved end which is connected with an elongated member smaller than the termination body. The inner liner of the composite tubular tendon abuts the circular opening in the hollow termination body and fibers of the composite tubular tendon are extended over and cover the termination body from the point of abutment to the elongated member which is smaller than the termination body. The axial fibers of the composite tubular tendon are continued over the termination body in a geodesic path and the helical fibers are continued over the termination body in a helical path.

20 Claims, 2 Drawing Sheets

HIGH AXIAL LOAD TERMINATION FOR TLP TENDONS

BACKGROUND OF THE INVENTION

Advanced composite materials offer several advantages which make them very viable for use in constructing tension leg platform tendons for use in deepwater application. These advantages include light weight, high strength, high elastic modulus and corrosion resistance. Two approaches have been advanced for composites, one is used to use composite cables and the second is to use composite tubulars. Composite tubulars offer several advantages over ropes or cables. For example, they can be designed with positive buoyancy, they allow easy inspection and the internal space in the tubular can be used to activate the lower anchor connector of the tendon using a hydraulic fluid. For TLP applications, the design of tendons is primarily controlled by the axial stiffness. High axial stiffness which is required necessitates that the fibers in the composite tubular be laid in a near axial direction which makes both the fabrication using conventional filament winding process and termination using adhesively bonded joint almost impractical. Also, if another extrusion process such as pultrusion is considered, rather than the filament winding process, it may not be suitable because the tubulars require some helical layers of fibers to provide the necessary pressure resistance. This makes filament winding the most practical construction route for such tubulars. Since TLP tendons are subjected to high axial loads, the use of a conventional termination that relies on the shear strength of the interface between the composite and the termination is not suitable.

It would be desirable to provide a termination which can be used with composite tubulars and which has sufficient shear strength to satisfy the requirements of tension leg tendons for tension leg platforms.

PRIOR ART

U.S. Pat. No. 4,149,277 issued to Bokros relates to an artificial tendon or ligament prosthesis. It discloses anchoring the tendon or ligament by passing it through a graphite plug and forming a loop which is held on the other side of the graphite plug by a carbon coated metallic or graphite pin.

U.S. Pat. No. 4,248,549 issued to Czerewaty discloses anchoring the lower end of a flexible line to a subsea base wherein the line extends upwardly through a guide member which is flared upwardly along a gradually curved surface. The portion of the line within the curved surface contains a series of rings of rigid material attached around the cable and spaced from each other. Each of the rings contains within it a flexible material which is in contact with the cable. The rings permit bending of the cable but hold the cable free from contact with the flared opening of the socket.

U.S. Pat. No. 4,420,276 issued to Roberts discloses a tethered buoyant platform in which each tether terminates in a collar of zinc or epoxy resin to provide a cushioning medium, the resin being contained within a steel socket surround the tether.

THE INVENTION

The invention comprises a curved hollow termination with a circular opening at one end and with the opposite curved end connected with an elongated member of lesser cross-section and a composite tubular tendon containing axial fibers and helical fibers laid on an inner liner which abuts the circular opening of the termination; with the fibers of the composite tubular tendon extending over and covering the termination body from the area of abutment with the composite tubular tendon to the elongated member of lesser diameter than the termination body. In one aspect of the invention, the opposite curved end of the hollow termination body is semi-spherical in shape and in another aspect is semi-ovoid in shape.

DETAILED DESCRIPTION OF THE INVENTION

Figure 1:
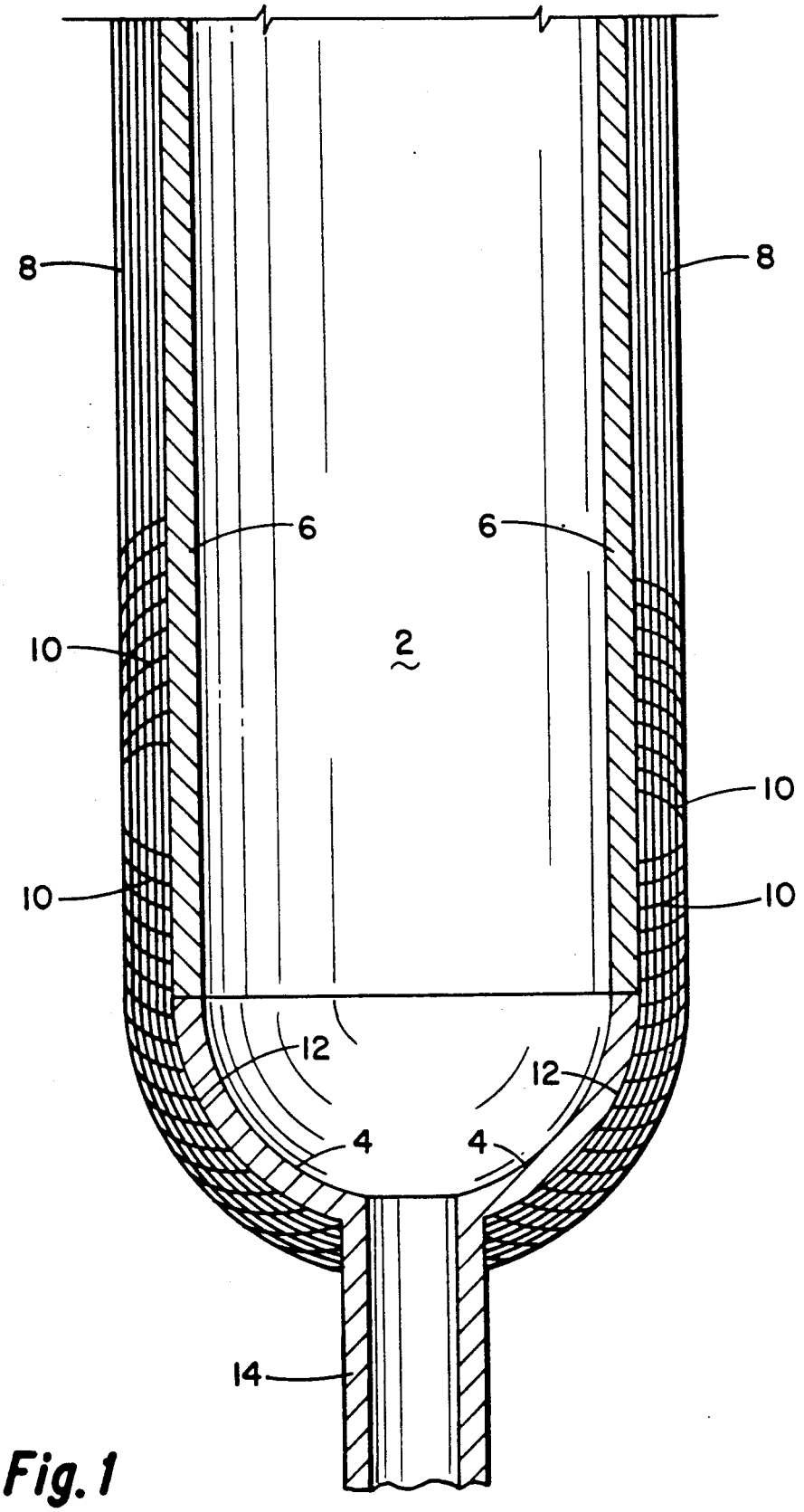
FIG. 1 is a schematic diagram in cross section of a semi-spherical termination illustrative of the invention.

The curved high axial load termination of the invention may best be described by reference to the drawings. Referring to FIG. 1, a semi-spherical termination body 4 which is usually constructed of metal or other rigid material, is butted against the inner liner 6 of a composite tubular tendon 2. Elongated member 14 which may be a solid or tubular member and may be an integral part of the termination body or may be attached thereto by a suitable threaded arrangement is adapted to be connected to an anchor (not shown) positioned on the bottom of the ocean floor or to a suitable connector on the tension leg platform. For hydraulic purposes, member 14 is preferably a tubular member. Composite tubular tendon 2 is comprised of axial fibers 8 and helical fibers 10 which are laid on liner 6 and are held together with a suitable resin material. Both axial fibers 8 and helically wound fibers 10 are continued and extended over termination body 4 to the point of intersection of that body with elongated member 14. Hollow termination body 4 is shown in FIG. 1 as a semi-spherical body, however, other curved shapes could be used for this body as for example, a semi-ovoid shape. Also, although termination body 4 is shown as ending at the point of maximum cross section of this body, it may be extended in length to form a cylindrical portion of the termination body, replacing a portion of inner liner 6 adjacent the termination body. The diameter of the large open end of the curved termination body will vary in size to meet the requirements of the composite tubular tendon. Usually, this diameter will vary from about 10 to about 50 inches.

A variety of composite fibers may be used to form the composite tubular tendons used with the termination of the invention. Fibers such as graphite, aramid fibers such as Kevlar®, boron fibers, all have high strength, high stiffness and are light weight. The axial fibers are preferably made up of carbon or graphite fibers or aramid fibers such as Kevlar®, all of which have high stiffness and a high elastic modulus. The helical fibers may be made of a variety of materials including fiberglass, aramid fibers, polyethylene, etc. The fibers contained in the composite tubular tendon are held together with a suitable plastic binder such as vinyl ester, epoxy, or a thermoplastic or thermosetting resin.

The fibers of the composite tubular tendon are laid on an inner liner which not only supports the fibers, but also serves to provide a pressure tight chamber. The liner is typically made up of an abrasion and chemically resistant material such as Teflon ®, Kevlar ®, or Hytrel ®, sold by Du Pont, nylon or Rilsan ®, which is sold by ATO Chem, or Kevlar ® frit. Although it is not shown in FIG. 1, the composite tubular tendon may also be covered with a protective abrasion resistant cover to resist any wear or friction which the tubular member may encounter. Here again, materials such as Kevlar ®, Teflon ®, nylon, Rilsan ®, Hytrel ®, or Kevlar ® frit may be used to form this protective covering.

Figure 2:
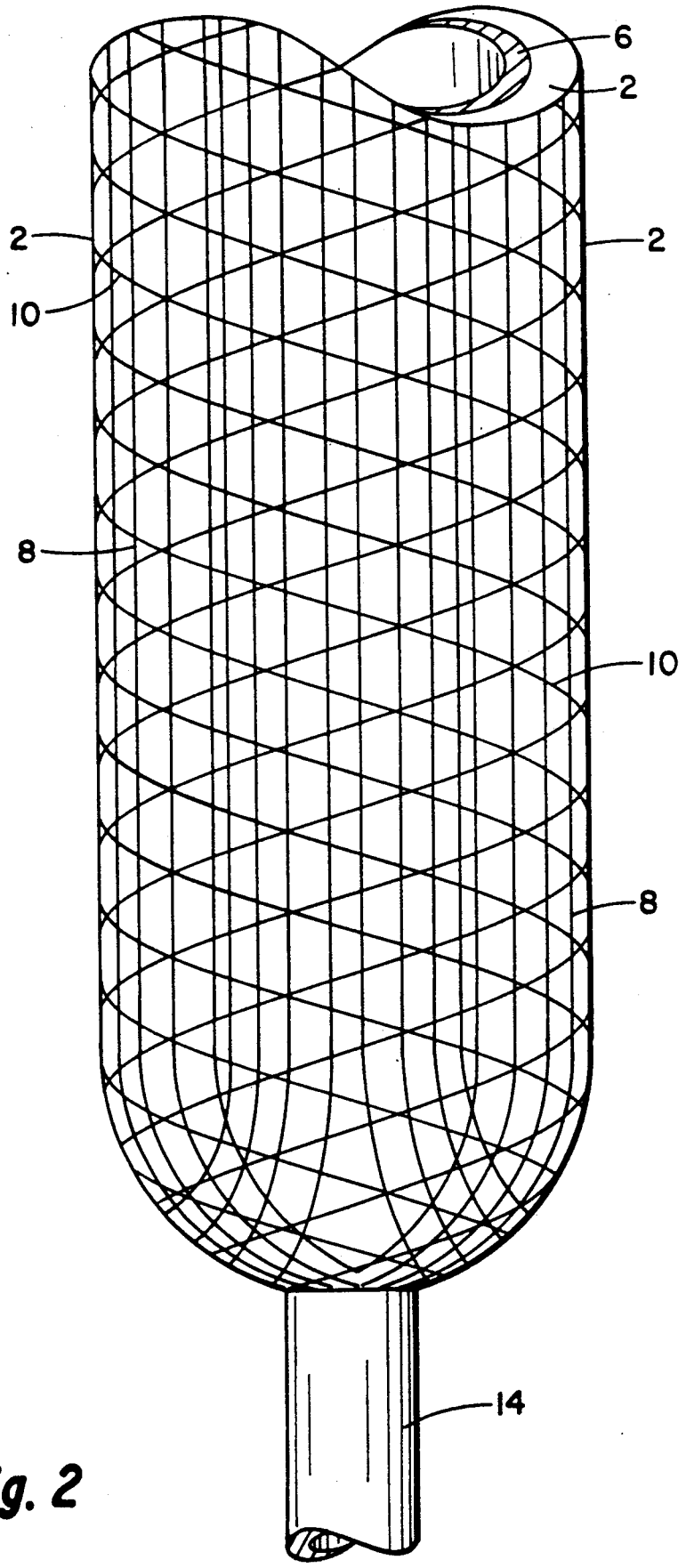
FIG. 2 is a schematic diagram of the same termination showing the arrangement of axial and helically wound fibers of the composite tubular tendon extending over the semi-spherical termination body.

FIG. 2 is a non-sectional view of the same termination shown in FIG. 1 in cross section. In this Figure, the axial fibers 8 are continued from the composite tubular tendon over the termination body in a geodesic path. The helical wound fibers 10 are oriented on the composite tubular tendon in cross ply orientation at an angle from ±40° to ±85° to the axis of the tendon. More preferably, the helical wound fibers are oriented as cross plies of ±45° fibers. The cross ply fibers are continued from the composite tubular tendon over the termination body at basically the same angle to the axis of the composite tubular tendon.

The major portion of the composite tubular tendon is made up of fibers in axial alignment, usually between about 50 and about 95 percent and preferably between about 70 and about 90 percent. These are the fibers which provide high axial stiffness, high tensile strength and low bending stiffness to the composite tubular tendon. The helical wound fibers which usually comprise between about 5 and about 50 percent of the total fibers in the composite tubular tendon and preferably between about 10 and about 20 percent provide resistance to shear stress and also pressure resistance.

Depending on their diameter, the composite tubular tendons usually will have a fiber-resin thickness of between about 0.5 and about 4 inches.

The liner of the composite tubular tendon will usually have the same thickness as the abutting edge of the hollow termination body, between about 0.5 and about 2 inches. However, this is not essential and the abutting edge of the hollow termination may be either thicker or thinner than the liner of the composite tubular tendon, provided that the outside diameter of the hollow termination body is the same as the outside diameter of the liner. If the liner is thicker than the hollow termination, it may be machined to both abut the edge of the termination and cover part of the internal surface of the hollow termination.

FIGS. 1 and 2 show one end of a composite tubular tendon. If the drawings represent the bottom end of a tubular tendon, then tubular tendon 14 is attached by a suitable means to an anchor on the ocean floor. The other end of the tubular tendon made up of a similar termination as shown in the Figures is connected to the tension leg platform and placed under the desired tension to control the movement of the platform.

The methods of attachment employed may be any of those disclosed in the art. For example, the terminations may be attached by keyhole latching or by using a side entry opening such as shown in U.S. Pat. Nos. 4,746,247; and 4,784,529 which are hereby incorporated by reference.

Only the portion of termination 4 adjacent tubular tendon 14 is shown in the Figures. The remainder of the termination which is configured to effect attachment of the termination either at the ocean floor or at the tension leg platform is constructed using any suitable design disclosed in the art. Such design and attachment features do not constitute a part of the present invention.

In assembling a termination as shown in the drawings, hollow termination bodies are mounted on a filament winding machine. The fibers which form the composite tubular tendon are laid axially between the terminations and on a geodesic path (minimum length) on the termination bodies. When a helical layer is desired, the filament winding machine is programmed to provide such a layer. The semi-spherical or ovoid shape of the hollow termination body allows the tensile load on the composite tubular tendon to be transferred between the hollow termination body and the main body of the composite tubular tendon through both axial load in the fibers and the shear of the interface between the hollow termination body and the liner of the composite tubular tendon. This interface is subjected to compressive load which increases its shear resistance and thus provides a much stronger connection.

While certain embodiments and details have been shown for the purpose of illustrating the present invention, it will be apparent to those skilled in the art that various changes and modifications may be made herein without departing from the spirit or scope of the invention.

I claim:

1. A hollow high axial load termination for a composite tubular tendon, comprising:

(a) a curved hollow termination body open at one end with a circular opening and connected at the opposite curved end with an elongated hollow member of lesser diameter than the diameter of the circular opening of the termination body, (b) a composite tubular tendon containing axial fibers and helical fibers laid on an inner hollow liner, said inner hollow liner abutting the circular opening of the termination body, (c) fibers of the composite tubular tendon extending over and covering the termination body from the abutment with the composite tubular tendon to the elongated member of lesser diameter than the termination body, such that fluids are free to pass from the tubular tendon through the termination body.

2. The termination of claim 1 in which the opposite curved end is semi-spherical in shape.

3. The termination of claim 1 in which the opposite curved end is semi-ovid in shape.

4. The termination of claim 1 in which the end of the termination with the circular opening is extended to form a cylindrical portion of the termination.

5. The termination of claim 1 in which the composite tubular tendon contains from about 50 to about 95 percent axial fibers and from about 5 to about 50 helical fibers.

6. The termination of claim 5 in which the helical fibers are cross-plied and oriented at from ±40° to ±85° to the axis of the composite tubular tendon.

7. The termination of claim 6 in which the helical fibers are cross-plied and oriented at ±45° to the axis of the composite tubular tendon.

8. The termination of claim 5 in which the axial fibers of the composite tubular tendon are continued over the termination body in a geodesic path.

9. The termination of claim 8 in which the helical fibers are continued over the termination body in a helical path.

10. The termination of claim 9 in which the fibers of the composite tubular tendon are aramid fibers.

11. A hollow high axial load termination for a composite tubular tendon comprising:

(a) a hollow semi-spherical termination body open at the circular end and connected at the opposite curved end with a tubular member of lesser diameter than the diameter of the circular end of the termination body, (b) a hollow composite tubular tendon containing axial fibers and helical fibers cross-plied and oriented from ±40° to ±85° to the axis of the composite tubular tendon, laid on a hollow inner liner, said hollow inner liner abutting the circular opening of the termination body, (c) fibers of the composite tubular tendon extending over and covering the termination body from the abutment with the composite tubular tendon to the tubular member of lesser diameter than the termination body, such that fluids are free to pass from the tubular tendon through the termination body.

12. The termination of claim 11 in which the composite tubular tendon contains from about 50 to about 95 percent axial fibers and from about 5 to about 50 percent helical fibers.

13. The termination of claim 12 in which the helical fibers are cross-plied and oriented at ±45° to the axis of the composite tubular tendon.

14. The termination of claim 13 in which the axial fibers of the composite tubular tendon are continued over the termination body in a geodesic path.

15. The termination of claim 14 in which the helical fibers are continued over the termination body in a helical path.

16. A hollow high axial load termination for a composite tubular tendon comprising:

(a) a hollow semi-ovoid termination body having an open circular end and connected at the opposite curved end with a tubular member of lesser diameter than the diameter of the circular end of the termination body, (b) a composite tubular tendon containing axial fibers and helical fibers crossplied and oriented from ±40° to ±85° to the axis of the composite tubular tendon, laid on a hollow inner liner, said hollow inner liner abutting the circular opening of the termination body, (c) fibers of the composite tubular tendon extending over and covering the termination body from the abutment with the composite tubular tendon to the tubular member of lesser diameter than the termination body, such that fluids are free to pass from the tubular tendon through the termination body.

17. The termination of claim 16 in which the composite tubular tendon contains from about 50 to about 90 percent axial fibers and from about 5 to about 50 helical fibers.

18. The termination of claim 17 in which the helical fibers are cross-plied and oriented at ±45° to the axis of the composite tubular tendon.

19. The termination of claim 18 in which the axial fibers of the composite tubular tendon are continued over the termination body in a geodesic path.

20. The termination of claim 19 in which the helical fibers are continued over the termination body in a helical path.

* * * * *